US007257966B2

(12) United States Patent
Lee et al.

(10) Patent No.: US 7,257,966 B2
(45) Date of Patent: Aug. 21, 2007

(54) INTERNAL REFRIGERATION FOR ENHANCED NGL RECOVERY

(75) Inventors: Rong-Jwyn Lee, Sugar Land, TX (US); Ying Zhang, Houston, TX (US); Jame Yao, Sugar Land, TX (US); Jong Juh Chen, Sugar Land, TX (US); Douglas G. Elliot, Houston, TX (US)

(73) Assignee: IPSI, L.L.C., Houston, TX (US)

( * ) Notice: Subject to any disclaimer, the term of this patent is extended or adjusted under 35 U.S.C. 154(b) by 359 days.

(21) Appl. No.: 11/032,464

(22) Filed: Jan. 10, 2005

(65) Prior Publication Data

US 2006/0150672 A1 Jul. 13, 2006

(51) Int. Cl.
*F25J 3/00* (2006.01)

(52) U.S. Cl. ..... 62/620; 62/630

(58) Field of Classification Search ..... 62/620, 62/630, 631

See application file for complete search history.

(56) References Cited

U.S. PATENT DOCUMENTS

| | | | | |
|---|---|---|---|---|
| 3,055,183 | A * | 9/1962 | Kniel | 62/625 |
| 4,456,461 | A * | 6/1984 | Perez | 62/622 |
| 4,617,039 | A | 10/1986 | Buck | 62/26 |
| 4,657,571 | A | 4/1987 | Gazzi | 62/17 |
| 5,295,356 | A * | 3/1994 | Billy | 62/623 |
| 5,568,737 | A | 10/1996 | Campbell et al. | 62/621 |
| 5,588,308 | A | 12/1996 | Daugherty et al. | 62/622 |
| 5,771,712 | A | 6/1998 | Campbell et al. | 62/621 |
| 5,890,378 | A | 4/1999 | Rambo et al. | 62/621 |
| 5,992,175 | A | 11/1999 | Yao et al. | 62/621 |
| 6,116,050 | A | 9/2000 | Yao et al. | 62/630 |
| 6,601,406 | B1 | 8/2003 | Deng et al. | 62/621 |
| 6,712,880 | B2 | 3/2004 | Foglietta et al. | 95/184 |
| 6,837,070 | B2 | 1/2005 | Mak | 62/625 |
| 2002/0166336 | A1 * | 11/2002 | Wilkinson et al. | 62/620 |
| 2005/0183452 | A1 * | 8/2005 | Hahn et al. | 62/620 |

OTHER PUBLICATIONS

R. J. Lee, J. Yao and D. G. Elliot, *Flexibility, efficiency to characterize gas-processing technologies*, Dec. 13, 1999, pp. 90-94, Oil & Gas Journal.

C. Collins, R. J. J. Chen, and D. G. Elliot, *Trends in NGL Recovery from Natural and Associated Gases*, Nov. 6-9, 1984, 39 pages, paper prepared for presentation at Gastech 84 in Amsterdam.

* cited by examiner

*Primary Examiner*—William C. Doerrler
(74) *Attorney, Agent, or Firm*—Crain, Caton & James

(57) ABSTRACT

The present invention is directed to methods for improving the efficiency of processes for the recovery of natural gas liquids from a gas feed, e.g., raw natural gas or a refinery or petrochemical plant gas stream. These methods may be employed with most, if not all, conventional separation methods using distillation towers, e.g., a demethanizer and/or deethanizer column. The methods of the present invention involve installing an internal refrigeration system consisting of an open cycle refrigerant withdrawn from a distillation column and a closed cycle refrigerant derived from the open cycle refrigeration system. A separator is installed downstream of the recycle compressor discharge cooler in the open cycle refrigeration scheme. At least a portion of liquid withdrawn from this separator is used as a closed cycle refrigerant by indirect heat exchange with the inlet gas or other process streams. Thus a closed refrigeration cycle enhances the performance of the open refrigeration cycle.

17 Claims, 7 Drawing Sheets

A graphical representation of the reduction of tray temperatures for the process illustrated in FIG. 3 (Tray numbers are from top to bottom. Tray 1 is the top tray.)

A graphical representation of the increase of tray volatility for the process illustrated in FIG. 3 (Tray numbers are from top to bottom. Tray 1 is the top tray.)

INTERNAL REFRIGERATION FOR ENHANCED NGL RECOVERY

FIELD OF THE INVENTION

The present invention relates to systems and methods for more efficient and economical separation of hydrocarbon constituents and recovery of both light gaseous hydrocarbons and heavier hydrocarbon liquids. In particular, the methods of the present invention more efficiently and more economically separate ethane, propane, propylene and heavier hydrocarbon liquid from any hydrocarbon gas stream, i.e., from natural gas or from gases from refineries or petrochemical plants.

BACKGROUND OF THE INVENTION

In addition to methane, natural gas includes some heavier hydrocarbons with impurities, e.g., carbon dioxide, nitrogen, helium, water, and non-hydrocarbon acid gases. After compression and separation of these impurities, natural gas is further processed to separate and recover natural gas liquids (NGL). In fact, natural gas may include up to about fifty percent by volume of heavier hydrocarbons recovered as NGL. These heavier hydrocarbons must be separated from methane to be recovered as natural gas liquids. These valuable natural gas liquids consist of ethane, propane, butane, and other heavier hydrocarbons. In addition to these NGL components, other components including hydrogen, ethylene, and propylene may be contained in gas streams obtained from refineries or from petrochemical plants.

Processes for separating hydrocarbon gas components are well known in the art. C. Collins, R. J. Chen, and D. G. Elliot have provided an excellent general review of NGL recovery methods in a paper presented at Gas Tech LNG/LPG Conference 84. This paper, entitled "Trends in NGL recovery for natural and associated gases", was published by Gas Tech, Ltd. of Rickmansworth, England, in the transactions of the conference on pages 287-303. In addition, R. J. Lee, J. Yao, and D. G. Elliot provided an excellent general review of NGL recovery methods in a paper entitled "Flexibility, efficiency to characterize gas-processing technologies", which was published in the Dec. 13, 1999 issue of Oil & Gas Journal on pages 90-94. The pre-purified natural gas is treated by well-known methods including absorption, refrigerated absorption, adsorption and condensation at cryogenic temperatures down to −175° F. Separation of the lower hydrocarbons is achieved in one or more distillation towers. The columns are often referred to as demethanizer or deethanizer columns. Processes employing a demethanizer column separate methane and other volatile components from ethane and heavier (C2+) components in the purified natural gas liquids. The methane fraction is recovered as purified gas for pipeline delivery. Ethane and less volatile components, including propane, are recovered as natural gas liquids. In some applications, however, it is desirable to minimize the ethane content of the NGL. In those applications, ethane and more volatile components are separated from propane and less volatile (C3+) components in a column generally called the deethanizer column.

NGL recovery plant design is highly dependent on the operating pressure of the distillation column. At medium to low pressures, i.e., 400 psia or lower, the recompression horsepower requirement (to compress the residue gas to pipeline pressure) will be so high that the process becomes less economical. However, at higher pressures, the recovery level of the hydrocarbons will be significantly reduced due to the less favorable separating conditions, i.e., lower relative volatility inside the distillation column. Prior art has concentrated on operating the distillation columns at a higher pressure, i.e., 400 psia or higher while maintaining the high recovery of liquid hydrocarbons.

Many patents have been directed to methods for improving this separation technology. U.S. Pat. Nos. 4,171,964, 4,278,457, 4,687,499, and 4,851,020 describe relevant processes.

While single-column processes utilizing only the demethanizer have been capable of recovering more than 98% of the propane, propylene, and heavier hydrocarbons during the ethane recovery mode, most of those processes fail to maintain the same propane recovery level when ethane is not needed and operated in the ethane rejection mode. Due to equilibrium constraints, the propane recovery in a single-column arrangement is ultimately limited by propane content in the top reflux to the demethanizer. To overcome this deficiency, various methods employing sequentially configured first and second distillation columns, e.g. a demethanizer followed by a deethanizer, are disclosed. In this arrangement, the overhead vapor from the second column is condensed and recycled to the top of the first column as the reflux. The top reflux thus derived is essentially propane-free, thereby enhancing propane recovery efficiency.

In the afore-mentioned two-column arrangement, most prior art uses the first column comprising only the rectification section like an absorber. The absorber bottom liquids are transported to the second column for further processing to generate a reflux lean in propane for use as the top reflux to the first column. For examples, see U.S. Pat. Nos. 4,617,039, 4,690,702, 5,771,712, 5,890,378, 6,601,406, 6,712,880, and 6,837,070. An improved two-column scheme disclosed in U.S. Pat. No. 6,116,050 thermally links both distillation columns via a side reboiler-overhead condenser and introduces a stripping section to the first column. The provision of the stripping section allows undesirable light components to be stripped off the liquids feeding to the second column.

A significant cost in the NGL recovery processes is related to the refrigeration required to chill the inlet gas. Refrigeration for these low temperature schemes is generally provided by using propane or ethane as refrigerants. In some applications, mixed refrigerants and cascade refrigeration cycle have been used. Refrigeration is also provided by turbo expansion or work expansion of the compressed natural gas feed with appropriate heat exchange.

Traditionally, the gas stream is partially condensed at medium to high pressures with the help of external propane refrigeration, a turboexpander or both. The condensed streams are further processed in a distillation column, e.g., a demethanizer or deethanizer, operated at medium to low pressures to separate the lighter components from the recovered hydrocarbon liquids. Turboexpander technology has been widely used in the last 30 years to achieve high ethane and propane recoveries in the NGL for leaner gases. For rich gases containing significant quantities of heavy hydrocarbons, a combined process of turboexpander and external refrigeration is the most efficient approach. Mechanical refrigeration consisting primarily of a pure refrigerant and in closed circuit, such as propane, is commonly used as the source of external refrigeration in cryogenic turbo expansion processes.

In addition to the external propane refrigeration, the use of an auto-refrigeration system has been utilized in prior art. U.S. Pat. No. 5,588,308 discloses that NGL product is recovered by cooling and partial condensation of a purified natural gas feed wherein a portion of the necessary feed cooling and condensation duty is provided by expansion and vaporization of condensed feed liquid after methane stripping, thereby yielding a vaporized NGL product. Additional refrigeration for feed gas cooling is provided by vaporizing methane-stripped liquid, which in turn provides boilup vapor for the stripping step. This process eliminates the need for external refrigeration with the aid of auto-refrigeration and integrated heat exchange.

U.S. Pat. No. 5,992,175 introduces a self-refrigeration scheme in open cycle to improve the efficiency and economy of processes for the recovery of natural gas liquids (NGL) from a gas feed under pressure. In this process, a portion of a hydrocarbon liquid is withdrawn from the lower portion of a distillation column. This withdrawn liquid hydrocarbon is expanded and heated to produce a two-phase system for separation into a heavy, liquid hydrocarbon product and a vapor phase for recycling to the column, preferably as an enhancement vapor. The withdrawn hydrocarbon liquid is preferably heated by indirect heat exchange with the inlet gas, thus reducing or eliminating the external refrigeration requirements of the process. The expanded, heated vapor recycled to the column increases the ethane and propane concentration in the column, thus reducing the tray temperature profile and increasing the separation efficiency. Accordingly, the column may be operated at higher pressures while maintaining the same separation efficiency, resulting in significant energy savings and economies of operation.

The open refrigeration cycle disclosed in the '175 patent not only reduces the requirements for external refrigeration, but also provides essentially all the reboiler duty for the distillation column. However, the reboiler duty required for the distillation column is generally limited to the specific distillation objective. Therefore, the refrigeration that can be effectively employed by this technique is somewhat restricted. In some cases where a large amount of external refrigeration is needed, there seems to be a shortage of refrigeration that can be produced via the above technique as a result of this limitation. This is particularly true for a relatively rich gas.

As can be seen from the foregoing description, prior art has long sought methods for improving efficiency and economics of processes for separating and recovering natural gas liquids from natural gas. Accordingly, there has been a long-felt but unfulfilled need for more efficient and more economical methods for performing this separation. The present invention provides significant improvements in efficiency and economy, thus solving those needs.

SUMMARY OF THE INVENTION

The present invention is directed toward processes for the separation and recovery of NGL from a hydrocarbon-containing raw gas feed under pressure. In the methods of the present invention, a gas feed is processed in one or more distillation columns, e.g., a demethanizer and/or deethanizer column, to separate the lighter hydrocarbon gases from the heavier natural gas liquids (NGL).

As mentioned above, U.S. Pat. No. 5,992,175 discloses an open cycle self-refrigeration scheme, which aims to improve the efficiency and economy of NGL recovery processes. The present invention discloses a self-refrigeration system consisting of a combination of both open and closed cycles, where the open cycle inherits the advantages of improved separation efficiency described in '175 patent, and the closed cycle supplements any refrigeration shortage beyond the range of open cycle. Instead of a pure refrigerant as in the external propane refrigeration, the resultant self-refrigeration consists of multiple component refrigerants.

In one form of the present invention, one or more hydrocarbon liquid streams are withdrawn from a distillation column. A portion of the withdrawn liquid is expanded to reduce its pressure and is used as an open cycle refrigerant by indirect heat exchange. The resulting two-phase stream is separated to produce a liquid stream and a vapor stream containing mainly ethane and propane. The vapor stream is further introduced to a recycle compressor. The repressurized gas stream exiting the recycle compressor is cooled in a recycle compressor cooler. A separator is installed downstream of the recycle compressor cooler to separate any condensed liquid stream. At least a portion of the liquid stream withdrawn from this separator is combined with the hydrocarbon liquid stream withdrawn from the column for use as refrigeration. This withdrawn liquid portion constitutes the closed self-refrigeration cycle. The vapor stream from the separator and the remaining portion of the liquid stream produced from the separator return to the column as the enhancement vapor, which constitutes the open self-refrigeration cycle. It should be noted that the vapor stream and the remaining liquid portion may return to the column at different locations. The portion of closed cycle refrigeration is specifically tailored such that the mixed refrigerant results in an essentially parallel form, namely minimum area, between the heating-cooling curves for the exchanger, a figure used to measure the efficiency of a refrigerant, where the mixed refrigerant is used.

The open refrigeration cycle as described in the enhancement vapor scheme reduces the requirement for external refrigeration and maximizes the provision of reboiler duty required. The closed refrigeration cycle provides additional refrigeration, which supplements the shortage of refrigeration and eliminates the need for external refrigeration. The economic advantages of the present invention become more important for a relatively rich gas, which include the following:

- Enhances the self-refrigeration efficiency by specifically tailoring the compositions of the mixed refrigerant.
- Lowers the temperature profile in the distillation column, thereby permitting better energy integration for inlet gas cooling via the use of reboilers and side reboilers, resulting in reduced external heating and refrigeration requirements.
- Reduces and/or eliminates the need for external reboiler heat, thereby saving fuel plus refrigeration.
- Enhances the relative volatility of the key components in the column, thereby improving separation efficiency and NGL recovery.

In another embodiment of the present invention, the portion of liquid withdrawn from the separator downstream of the recycle compressor cooler, namely the closed refrigeration portion, can be used as refrigerant, separately from the liquid stream withdrawn from the distillation column. In most cases, liquid refrigerant from the separator is heavier than the liquid withdrawn from the column. It will provide different refrigeration levels as needed for process cooling when the open and closed refrigerants are used separately. After indirect heat exchange with one or more process streams, the heated open and closed refrigerants are preferably combined and introduced into a common separator for separating the vaporized fraction. The vapor stream is further introduced to the recycle compressor and proceeds in the process similar to the previous embodiment. It should be noted that the heated open and closed refrigerants can be directed into their individual separators, which may or may not operate at the same pressure level, depending on the refrigeration level needed for each refrigerant. The compression of the refrigerant vapor can be carried out as required in multiple stages. The closed refrigerant vapor from the individual separator may be directed to the interstage of the compression.

Depending upon the refrigeration level and constituents of mixed refrigerant desired, the liquid draw from a distillation column, namely the open cycle refrigerant, may not be limited only to the first column in the case where multiple distillation columns are employed. In order to tailor mixed refrigerant components and to minimize surface areas for the exchangers where mixed refrigerant is used, the open cycle refrigerant disclosed in the aforementioned embodiments of the present invention may be optimally withdrawn from the second column, often known as deethanizer, in a two-column scheme. This is often the case when the first column comprising only the rectification section, such as an absorber, is employed in a two-column scheme for high levels of propane recovery.

BRIEF DESCRIPTION OF THE DRAWINGS

The application and advantages of the invention will become more apparent by referring to the following detailed description in connection with the accompanying drawings, wherein.

While the invention will be described in connection with the presently preferred embodiment, it will be understood that this is not intended to limit the invention to that embodiment. On the contrary, it is intended to cover all alternatives, modifications and equivalents as may be included in the spirit of the invention.

DETAILED DESCRIPTION OF THE INVENTION

The present invention broadens the application of '175 patent to overcome the aforementioned shortcomings. By introducing a self-refrigeration system consisting of both open and closed cycles, the external refrigeration requirement, electrical load and utility cost may be significantly reduced. Because of these improvements, the capital requirements and operating cost of recovering NGL present in the feed gas may be greatly reduced.

For the purpose of comparison, an exemplary prior art process will be described with reference to FIG. 1 and FIG. 2. The methods of the present invention will be described with reference to FIG. 3, FIG. 8, and FIG. 9. To the extent that temperatures and pressures as well as other process parameters are recited in connection with the methods of the present invention, those conditions are merely illustrative and are not meant to limit the invention.

Figure 1:
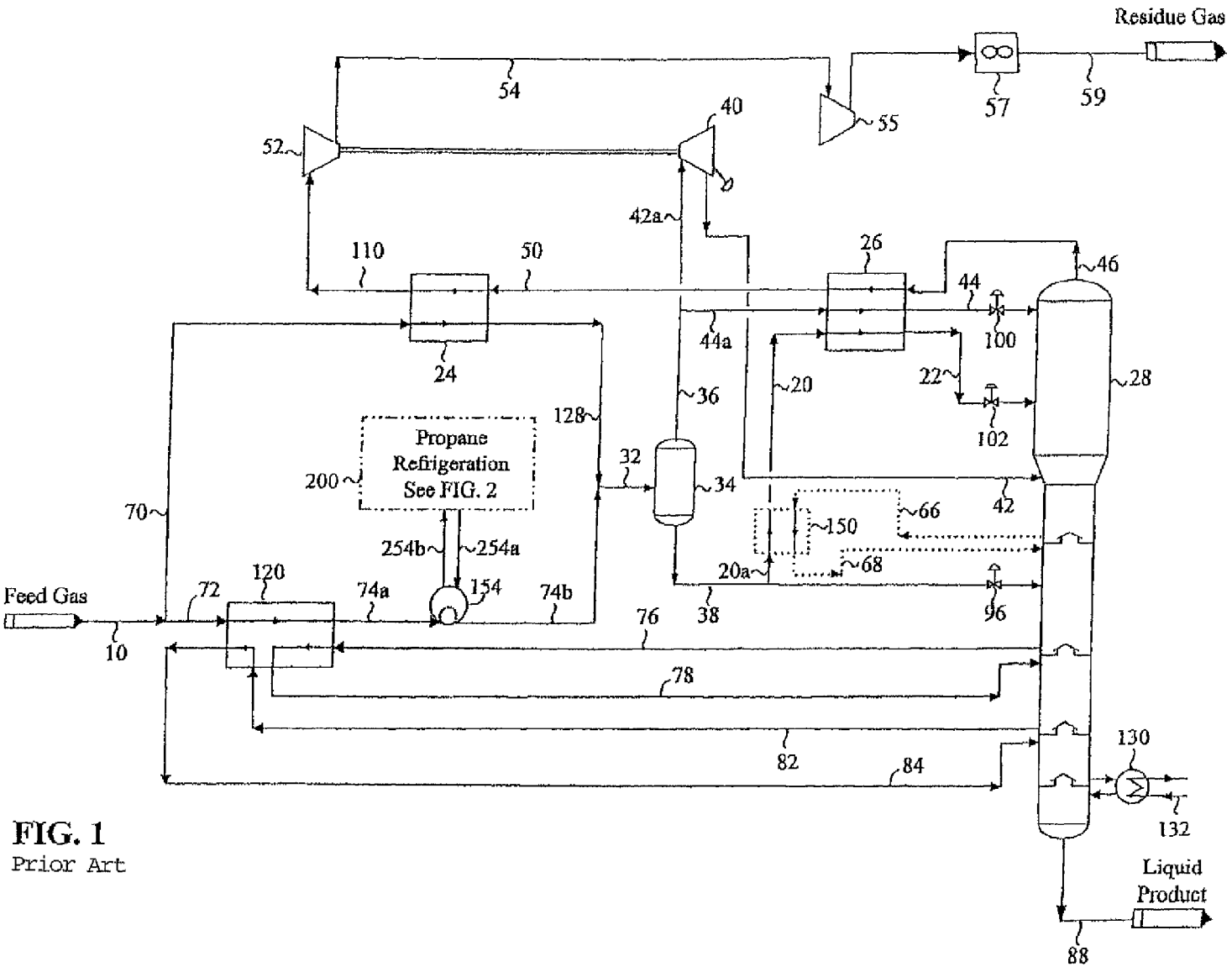
FIG. 1 Prior Art
FIG. 1 is a schematic flow diagram of a prior NGL separation process with external propane refrigeration for the purpose of comparison with the present invention.

Referring to FIG. 1, a feed gas comprising a pretreated and clean natural gas or refinery gas stream is introduced into the illustrated process through inlet stream 10 at a temperature of about 100° F. and an elevated pressure of about 915 psia. Feed stream 10 is split into streams 70 and 72, which are cooled separately in gas/gas exchanger 24 and gas/liquid exchanger 120. To improve NGL recovery, the cooled stream 74*a* from exchanger 120 is further cooled with an external propane refrigeration package 200 in propane chiller 154 to reduce the temperature of the stream to about −28° F. The details of the external propane refrigeration system are further illustrated in FIG. 2. Cooled stream 128 from exchanger 24 is combined with the other cooled stream 74*b* from propane chiller 154. The combined stream 32 at approximately −29° F. is introduced into the expander inlet separator 34 for separation of condensed liquid, if any, as stream 38. The liquid portion stream 38 is introduced into the middle of demethanizer 28 for further fractionation. Depending on the richness of the feed gas, it may be advantageous to subcool at least a portion of the liquid stream 38 and thereafter use it as liquid reflux in the middle portion of rectifying section, illustrated as stream 20*a*. Stream 20*a* may be optionally first cooled via a cold side reboiler 150 prior to being subcooled to approximately −131° F. via a reflux exchanger 26. This cooled liquid stream 22 is expanded through expansion valve 102 and fed to the demethanizer 28.

The vapor stream 36 from expander inlet separator 34 is divided into two portions, the main portion 42*a* and the remaining portion 44*a*. The main portion 42*a*, about 73%, is expanded through a work-expansion turbine 40 prior to entering the demethanizer 28 right below the top rectifying section as expander discharge 42. The remaining vapor portion 44*a* is cooled to substantially condensation, and in most cases subcooling, to approximately −131° F. via a reflux exchanger 26. This subcooled liquid stream 44 is expanded through expansion valve 100 to the top of demethanizer 28 as liquid reflux.

The demethanizer operated at approximately 387 psia is a conventional distillation column containing a plurality of mass contacting devices, trays or packings, or some combinations of the above. It is typically equipped with one or more liquid draw trays in the lower section of the column to provide heat to the column for stripping volatile components off from the bottom liquid product. This is accomplished via the use of a gas/liquid exchanger 120, and a cold side reboiler 150. The side draw liquids 66, 76 and 82 enter the heat exchangers 150 and 120 at −81, 24 and 79° F. respectively, and exit as streams 68, 78, and 84 at approximately −60, 68, and 90° F. respectively, prior to returning to the demethanizer to provide partial reboiler duty for the demethanizer. The remaining reboiler duty is provided by a heating medium 132 via a trim reboiler 130 to ensure that liquid product 88 from the bottom meets the required specifications.

The residue gas 46 exiting the upper portion of the demethanizer 28 is fed to the reflux exchanger 26, providing refrigeration for condensing/subcooling the vapor slipstream 44*a* from expander inlet separator 34 and subcooling the liquid stream 20 from the cold side reboiler 150. The residue gas exiting the reflux exchanger 26 is further warmed to near the feed gas temperature via gas/gas exchanger 24. The warmed residue gas 110 leaving the gas/gas exchanger 24 at approximately 94° F. is sent to the suction of the expander compressor 52, where it is compressed to 437 psia by utilizing work extracted from the expander 40. Depending upon the delivery pressure, a residue gas compressor 55 may be needed to further compress the residue gas stream 54, followed by an aftercooler 57 prior to its final delivery at 915 psia.

Figure 2:
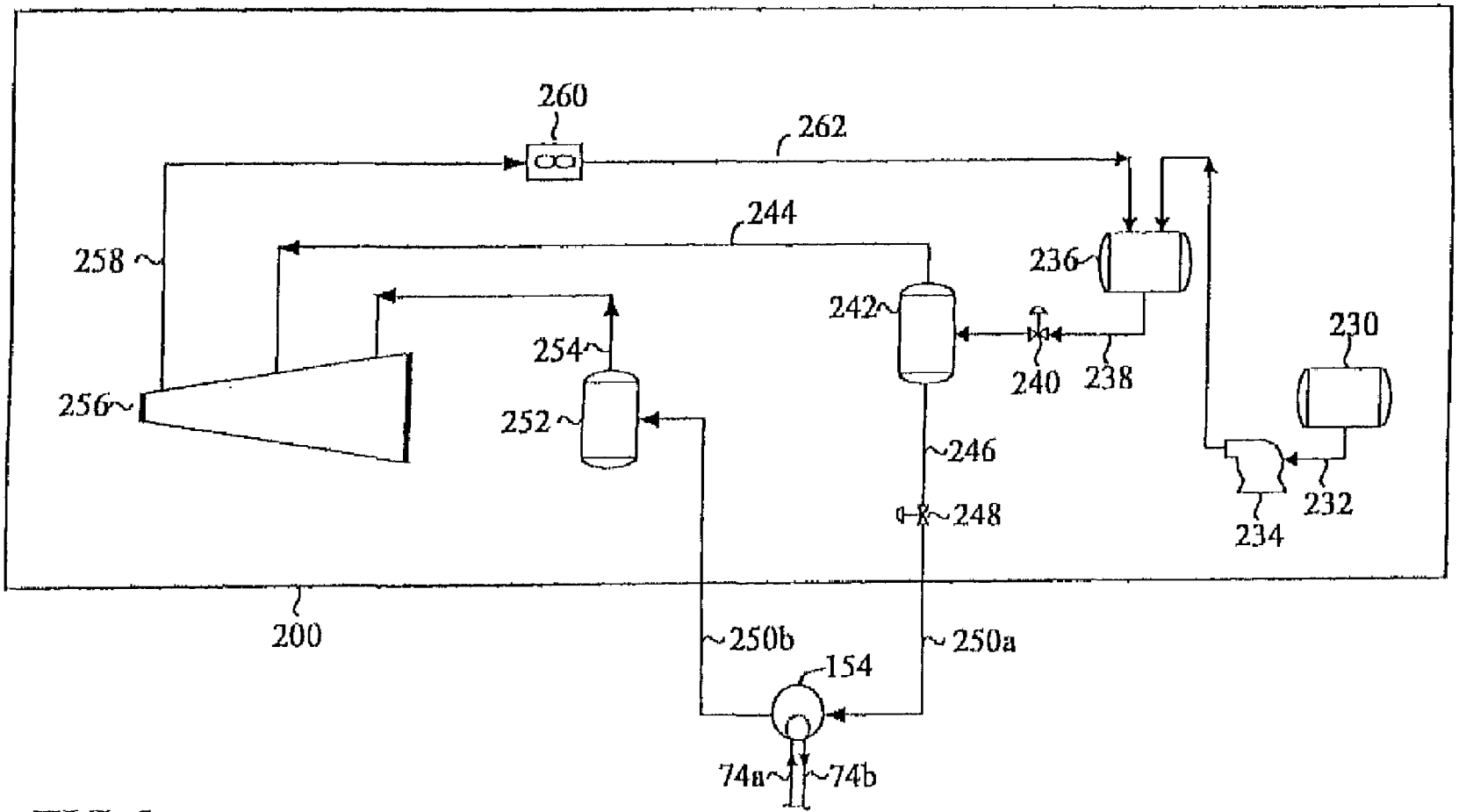
FIG. 2 Prior Art
FIG. 2 is a schematic flow diagram of the propane refrigeration system.

FIG. 2 shows the details of a typical external propane refrigeration system used in the propane chiller 154 represented in FIG. 1. Propane refrigerant 238 withdrawn from the accumulator 236 at approximately 120° F. and 247 psia is directed to a pressure reduction device, e.g., expansion valve 240, and expanded to a lower pressure of 85 psia. This pressure reduction process results in flashing a portion of the propane refrigerant and lowering its temperature to approximately 44° F. The resulting two-phase stream is fed to an economizer 242 where the flashed vapor 244 is separated from the remaining liquid propane 246. The flashed vapor 244 from economizer 242 is fed to the inter-stage inlet port of propane compressor 256. The remaining liquid propane 246 withdrawn from economizer 242 is directed to pressure reduction valve 248 to further reduce its pressure, thereby flashing an additional portion of propane refrigerant and further lowering its temperature to approximately −34° F. The resulting two-phase stream 250*a* is thereafter directed into the propane chiller 154 as a coolant in the indirect heat exchanger with the cooled feed gas 74*a* from gas/liquid exchanger 120 illustrated in FIG. 1.

The heated propane vapor 250*b* is introduced into a suction knockout drum 252 for removal of any entrained liquid refrigerant prior to being fed to the low-stage inlet port of propane compressor 256 through suction line 254. Propane vapor is compressed in two-stage propane compressor 256 as illustrated here. The repressurized propane vapor 258 flows through a propane condenser 260 where it is liquefied at about 120° F. prior to being returned via line 262 to propane accumulator 236.

As in a typical external refrigeration system, makeup of propane refrigerant is required periodically. This is accomplished via the use of a propane makeup pump 234 and a propane storage tank 230 as depicted in FIG. 2.

Table 1 presents the compositions of major streams along with the performance of the above mentioned prior art process illustrated in FIG. 1 and the use of an external propane refrigeration illustrated in FIG. 2 for a target ethane recovery of approximately 90% from a feed flow rate of 300 MMSCFD. As indicated in Table 1, the prior art process illustrated in FIG. 1 requires approximately 11,940 recompression horsepower for the residue gas to its delivery pressure of 915 psia. Additionally, propane refrigeration of approximately 7,200 HP is required to achieve a calculated ethane recovery of 89.8%.

TABLE 1

Overall performance of the prior art process as illustrated in FIG. 1 with external propane refrigeration

| | Stream and component flows in lbmole/hr | | | | | | | |
|---|---|---|---|---|---|---|---|---|
| Stream | Temp. ° F. | Pressure psia | Methane | Ethane | Propane | C4+ | Non-hydro-carbons | Total |
| 10 | 100 | 915 | 24704 | 3623 | 2306 | 1976 | 329 | 32938 |
| 46 | −134 | 387 | 24606 | 368 | 14 | 1 | 329 | 25318 |
| 88 | 105 | 392 | 98 | 3255 | 2292 | 1975 | 0 | 7620 |

| Other performance details | |
|---|---|
| % Ethane recovery | 89.8 |
| % Propane recovery | 99.4 |
| C2+ liquid product, BPD | 47,209 |
| Self-refrigeration compression, BHP | 0 |
| Propane refrigeration, BHP | 7,200 |
| Residue gas compression, BHP | 11,940 |

Figure 3:
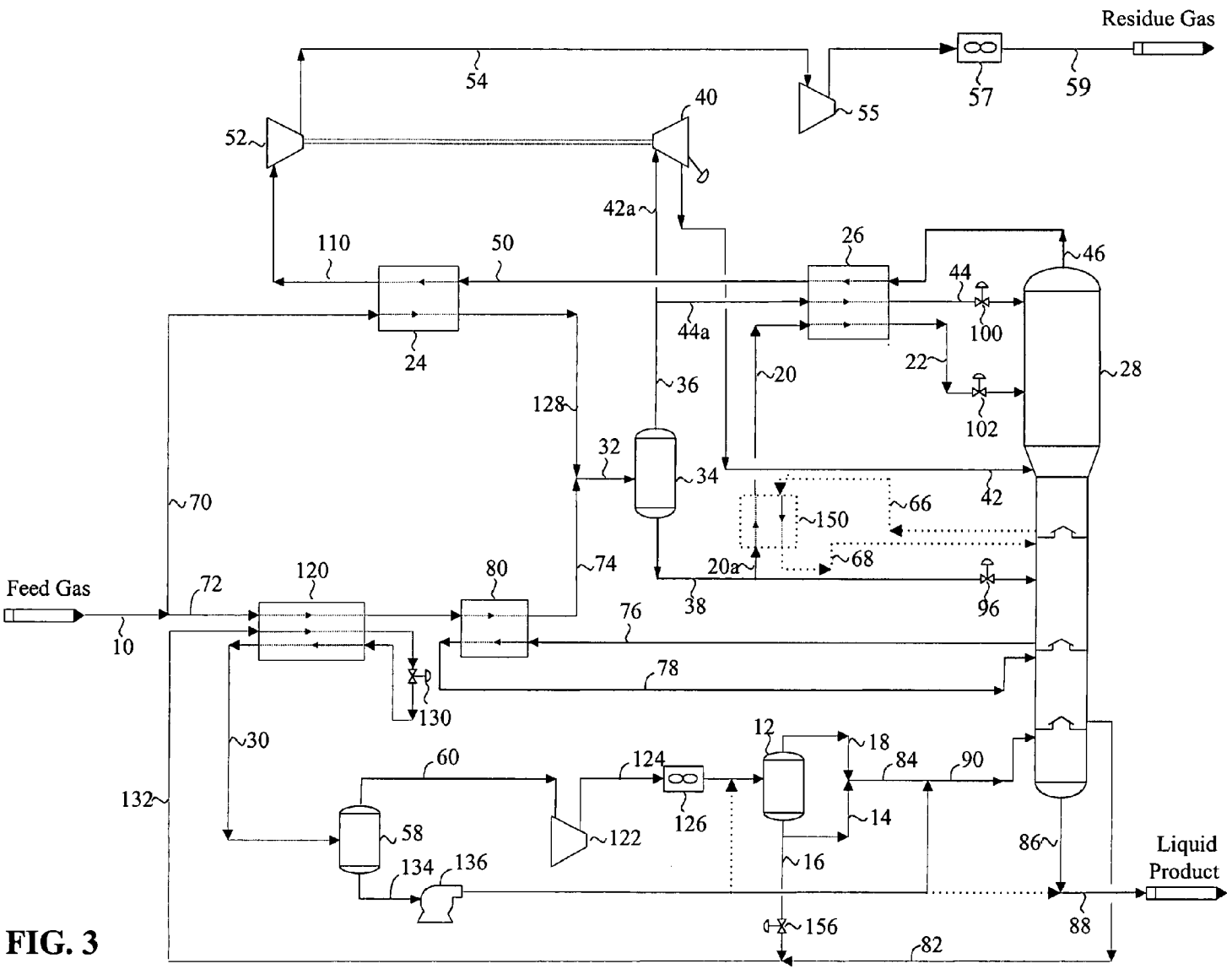
FIG. 3 is a schematic flow diagram of a NGL separation process incorporating the improvement of the present invention.

The methods of the present invention will now be illustrated with reference to FIG. 3, FIG. 8, and FIG. 9. Referring to FIG. 3, the same feed gas stream as in FIG. 1, which has been pretreated and cleaned, is introduced into the illustrated process through inlet stream 10 at a temperature of about 100° F. and a pressure of about 915 psia. The pretreatment typically involves removal of any concentration of sulfur compounds, mercury, and water as necessary. In some cases, the removal of $CO_2$ to a lower concentration is also required in the pretreatment to avoid potential freezing in downstream cryogenic processes. Feed stream 10 is split into streams 70 and 72, which are separately cooled in gas/gas exchanger 24 and gas/liquid exchanger 120 and side reboiler 80. Cooled stream 128 from exchanger 24 is combined with the other cooled stream 74 from exchanger 80. The combined stream 32 at approximately −26° F. is introduced into the expander inlet separator 34 for separation of condensed liquid, if any, as stream 38.

The liquid stream 38 withdrawn from separator 34 is delivered to the middle of demethanizer 28, after being flashed to near the demethanizer pressure in expansion valve 96. Again, depending on the richness of the feed gas, it may be advantageous to use at least a portion of liquid stream 38 as liquid reflux to the middle of the rectifying section, after being substantially subcooled. As illustrated, a portion of liquid stream 20*a*, taken from stream 38, is optionally cooled to approximately −77° F. via a cold side reboiler 150. Liquid collected in a chimney tray near the feed of the expander discharge 42 at approximately −82° F. may be optionally withdrawn as stream 66 to provide cooling for cold side reboiler 150. In this process, stream 66 is heated to approximately −59° F. as stream 68 and then fed back into the demethanizer at a location below where it is drawn and provides a portion of the reboiler duty for the demethanizer. The cold liquid stream 20 from cold side reboiler 150 is preferentially cooled further to approximately −131° F. in a reflux exchanger 26. Special attention should be paid to the temperature of subcooled liquid stream 22 to avoid potential freezing of heavy hydrocarbons contained in this stream. The subcooled liquid stream 22 is expanded through expansion valve 102 and introduced into the demethanizer 28 in the middle of the rectifying section as liquid reflux.

The vapor stream 36 from expander inlet separator 34 is divided into two portions, the major portion 42*a* and the remaining portion 44*a*. The major portion 42*a*, about 73%, is expanded through a work-expansion turbine 40 prior to entering the demethanizer 28 right below the overhead rectifying section as expander discharge 42. The remaining vapor portion 44*a* is cooled to substantial condensation, and in most cases subcooling, to approximately −131° F. via the reflux exchanger 26. This subcooled liquid stream 44 is expanded through expansion valve 100 and fed to the top of demethanizer 28 as top liquid reflux.

The demethanizer operated at approximately 385 psia is a conventional distillation column containing a plurality of mass contacting devices, trays or packings, or some combinations of the above. It is typically equipped with one or more liquid draw trays in the lower section of the column to provide heat to the column for stripping volatile components from the bottom liquid product. In addition to the cold liquid side draw 66 for use in the cold side reboiler 150, the side draw liquid 76 enters the side reboiler 80 at −37° F., and exits as stream 78 at approximately −2° F., prior to returning to the demethanizer to provide partial reboiler duty for the demethanizer. Within the demethanizer, less volatile components, namely ethane and heavier in this example of recovering ethane plus components, are recovered in bottom liquid product stream 86 while leaving more volatile, primarily methane and lighter compounds, in the top overhead vapor as residue gas stream 46.

The residue gas 46 exiting the upper portion of the demethanizer 28 is fed to the reflux exchanger 26, providing refrigeration for condensing/subcooling the vapor slipstream 44*a* from expander inlet separator 34 and subcooling the liquid stream 20 from the heat exchanger 150. The residue gas exiting the reflux exchanger 26 is further warmed to near the feed gas temperature via gas/gas exchanger 24. The warmed residue gas 110 leaving the gas/gas exchanger 24 at approximately 93° F. is sent to the suction of the expander compressor 52, where it is compressed to 437 psia by utilizing work extracted from the expander 40. The residue gas 54 from expander compressor 52 is further compressed via a residue gas compressor 55 and then cooled via aftercooler 57 prior to its final delivery at approximately 915 psia.

In this non-limiting embodiment of the present invention, the refrigeration provided by the residue gas from the demethanizer, the turbo expander 40, and the side liquid draws from the demethanizer is not sufficient to achieve the target 90+% ethane recovery. Thus, a self-refrigeration in a combination of open refrigeration cycle in the form of enhancement vapor scheme and closed refrigeration cycle detailed below is used for this purpose.

Stream 82, the open cycle refrigerant, is withdrawn from the chimney tray of the demethanizer column 28, and mixed with the closed cycle refrigerant, a portion of liquid stream 16 withdrawn from separator 12. The resultant mixed refrigerant 132 is preferentially fed to the gas/liquid exchanger 120 for subcooling prior to being expanded through expansion device 130 at 125 psia. To simplify the design of the gas/liquid exchanger, the drawn stream 82 can be directly expanded to a lower pressure without subcooling. The expanded stream is directed back to the gas/liquid exchanger 120 providing indirect heat exchange with the inlet gas stream 72, and thereafter fed to the suction knockout drum 58 where unvaporized liquid, if any, is separated. While the mixed refrigerant is used to cool the inlet gas stream illustrated here, it will be used for other process cooling as appropriate. The vapor stream 60 produced in knockout drum 58 is withdrawn from the top thereof to recycle compressor 122. The repressurized gas stream 124 exiting compressor 122 is cooled in recycle compressor cooler 126, resulting in partial condensation. The partially condensed product exiting recycle compressor cooler 126 is introduced into separator 12 where condensed liquid is separated. At least a portion of the liquid stream 16 withdrawn from separator 12 is combined with the liquid stream 82 withdrawn from the demethanizer, resulting in a mixed refrigerant 132, which is then directed to gas/liquid exchanger 120 for the use as refrigeration. The vapor stream 18 from the separator 12 returns to the demethanizer 28 as the enhancement vapor. While the enhancement vapor can be introduced back into various locations in the demethanizer, the location below the draw tray or at the bottom of the column will be more effective in most cases. The remaining liquid portion stream 14 from separator 12 is preferentially combined with the returning enhancement vapor stream 18 as stream 90. The temperature of stream 90 is modulated to ensure the remaining reboiler duty for the demethanizer is adequately provided via stream 90. Thus, the trim reboiler 130 needed in FIG. 1 is eliminated. It is to be noted that the remaining liquid portion stream 14 can optimally return to the demethanizer at a location different from that of vapor stream 18.

Depending on the richness of the feed gas and the amount of refrigeration needed, the flow rates of liquid stream 16 and liquid draw stream 82 are adjusted to optimally tailor the composition of mixed refrigerant stream 132 such that the distance between the heating and cooling curves in exchanger 120 is minimized, thereby maximizing the refrigeration efficiency.

The liquid stream 134 from suction knockout drum 58 comprising primarily heavier components is first raised in pressure via recycle pump 136 and is recycled to the demethanizer. It should be noted that as an option, a portion of the liquid stream from recycle pump 136 could be introduced into separator 12, as shown by the dashed line. It allows for tailoring the refrigerant in closed cycle as needed. In addition, the liquid stream 134 comprising less volatile NGL components could be optionally pumped and mixed with the bottom liquid 86 from the demethanizer 28 as the NGL product stream 88 via pump 136, as shown by the dashed line. Additionally, depending on the composition, liquid streams 14 and 134 can be optimally routed to a distillation column differently from where the open cycle refrigerant is withdrawn, in the case when multiple columns are utilized.

TABLE 2

| Overall performance of the inventive process as illustrated in FIG. 3 | | | | | | | | |
|---|---|---|---|---|---|---|---|---|
| | Stream and component flows in lbmole/hr | | | | | | | |
| Stream | Temp. ° F. | Pressure psia | Methane | Ethane | Propane | C4+ | Non-hydro-carbons | Total |
| 10 | 100 | 915 | 24704 | 3623 | 2306 | 1976 | 329 | 32938 |
| 46 | −135 | 385 | 24606 | 358 | 14 | 1 | 329 | 25308 |
| 88 | 104 | 390 | 98 | 3265 | 2292 | 1975 | 0 | 7630 |

| Other performance details | |
|---|---|
| % Ethane recovery | 90.1 |
| % Propane recovery | 99.4 |
| C2+ liquid product, BPD | 47,270 |
| Self-refrigeration compression, BHP | 5,515 |
| Propane refrigeration, BHP | 0 |
| Residue gas compression, BHP | 11,940 |

Figure 4:
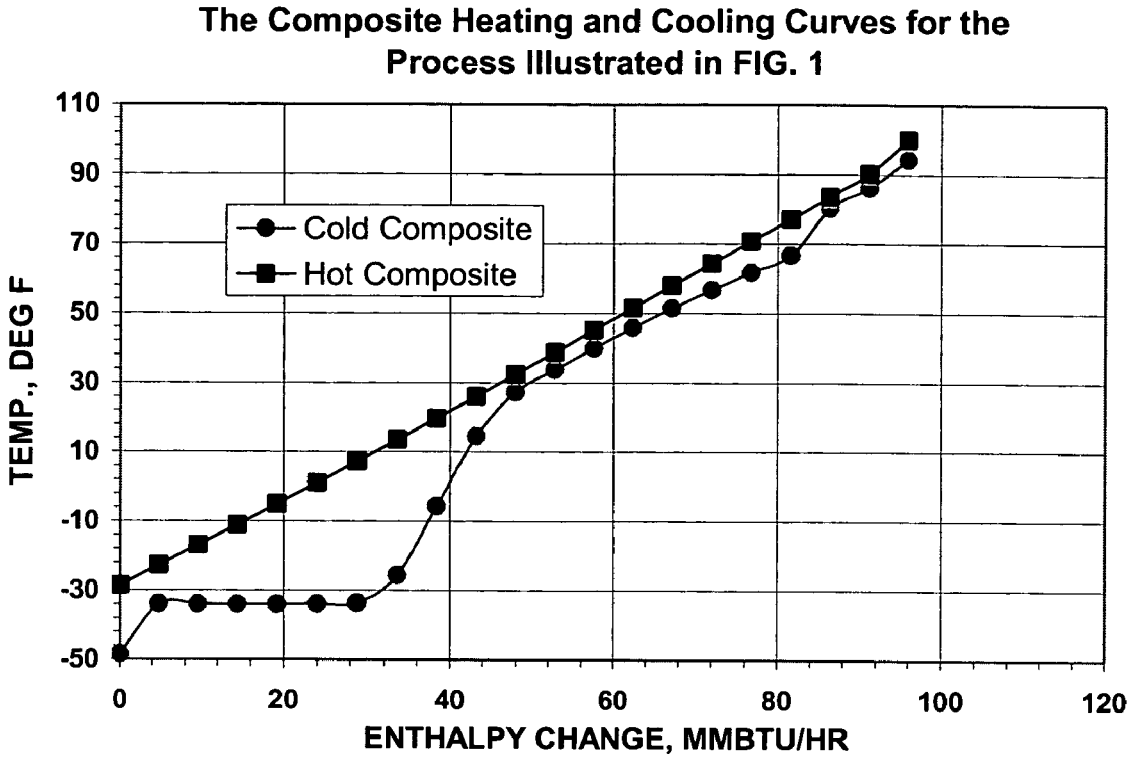
FIG. 4 is a graphical comparison of the composite heating and cooling curves for the processes illustrated in FIG. 1.
Figure 5:
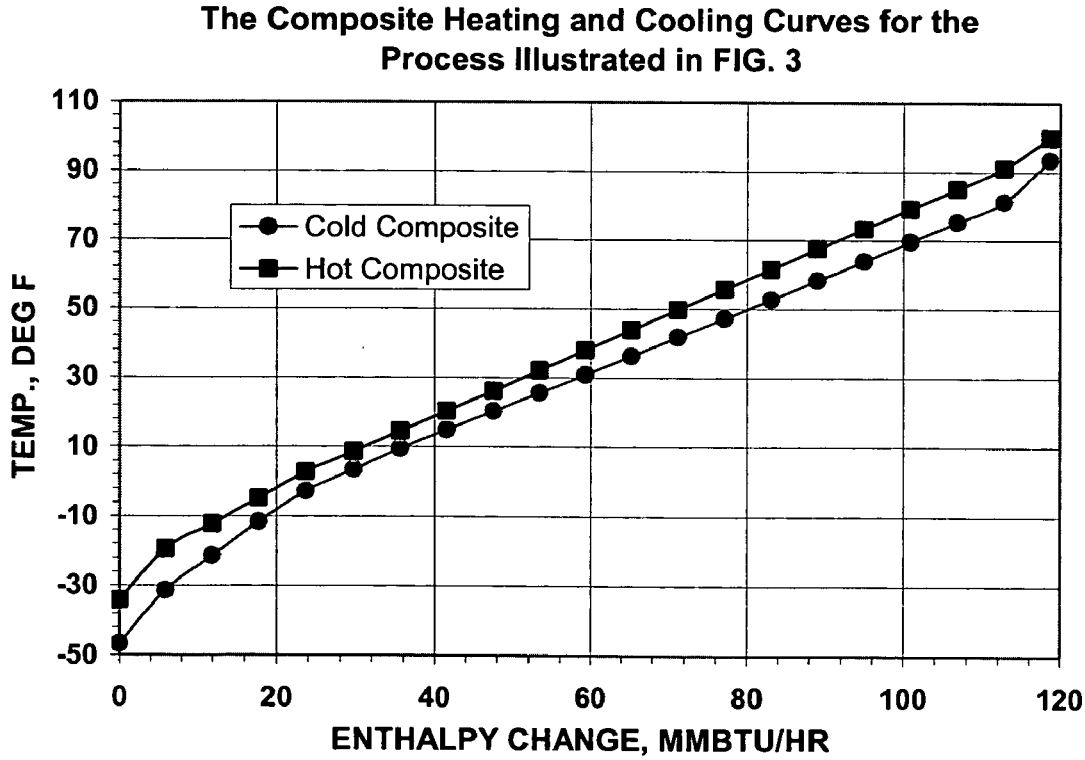
FIG. 5 is a graphical comparison of the composite heating and cooling curves for the processes illustrated in FIG. 3.

Table 2 presents the compositions of major streams along with the performance of above mentioned process implementing the present invention as illustrated in FIG. 3 for a target ethane recovery of approximately 90% from a feed flow rate of 300 MMSCFD. As indicated in Table 2, the inventive process illustrated in FIG. 3 requires approximately 11,940 recompression horsepower for the residue gas to its delivery pressure of 915 psia. Additionally, self-refrigeration of approximately 5,515 HP is required to achieve a calculated ethane recovery of 90.1%. This represents a savings in refrigeration horsepower by over 30%, as compared to conventional propane refrigeration where 7,200 HP is required as illustrated in Table 1. This is attributed to the mixed refrigerant disclosed in the present invention, which can be specifically tailored to effectively meet the need of process cooling. FIG. 4 shows the combined composite cooling and heating curves for exchangers 24, 120 and 154 used in FIG. 1 of the prior art process. FIG. 5 shows the combined composite cooling and heating curves for exchangers 24, 120, and 80 used in FIG. 3 of the present invention. As demonstrated, much closer heating/cooling curves are obtained from the inventive process of FIG. 3, reflecting a more efficient refrigeration scheme. Furthermore, the introduction of enhancement vapor eliminates the need for external reboiler heat, which is otherwise required via the trim reboiler for the prior art process in FIG. 1, thereby saving fuel and refrigeration.

Figure 6:
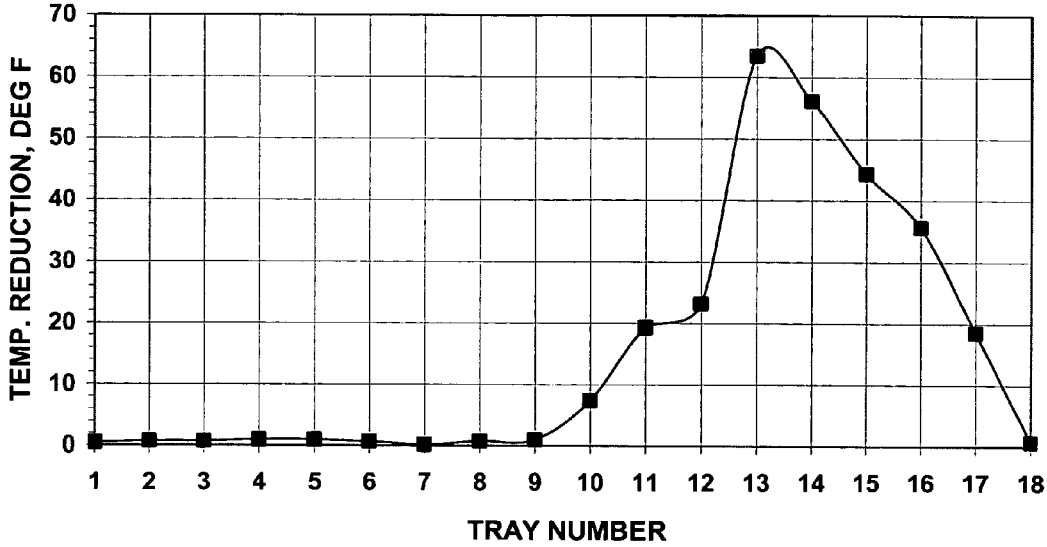
FIG. 6 is a graphical representation of the reduction of tray temperatures, which is achievable through use of the process of the present invention as illustrated in FIG. 3.
Figure 7:
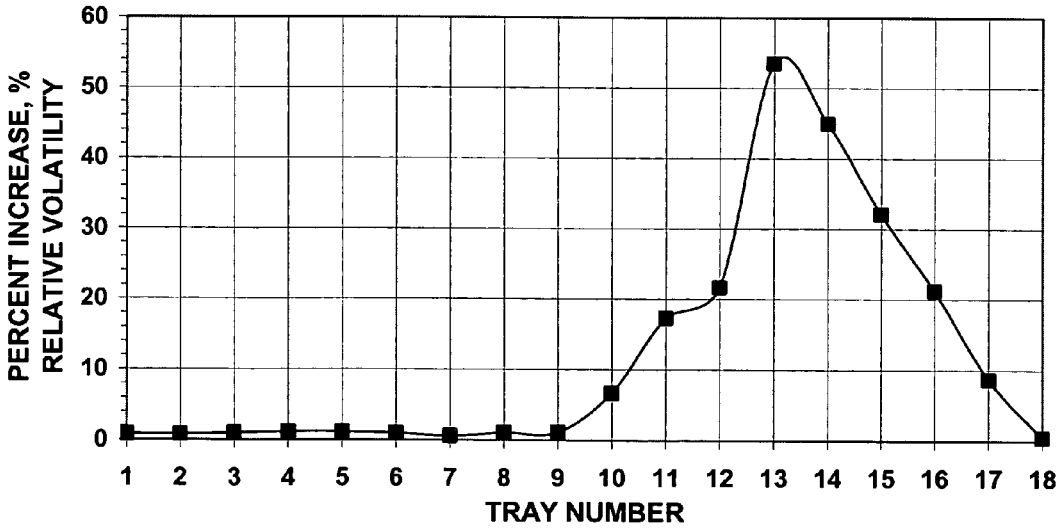
FIG. 7 is a graphical representation of the increase of tray relative volatility achievable through use of the process of the present invention as illustrated in FIG. 3.

Another advantage of the present invention is the lower temperature profile in the distillation column, thereby permitting better energy integration for inlet gas cooling via reboilers, resulting in reduced heating and refrigeration requirements, as shown in FIG. 6. In addition, the relative volatility of the key components (methane versus ethane) in the column is enhanced, thereby improving separation efficiency and NGL recovery. As demonstrated in FIG. 7, the relative volatility for the inventive process is significantly improved.

Figure 8:
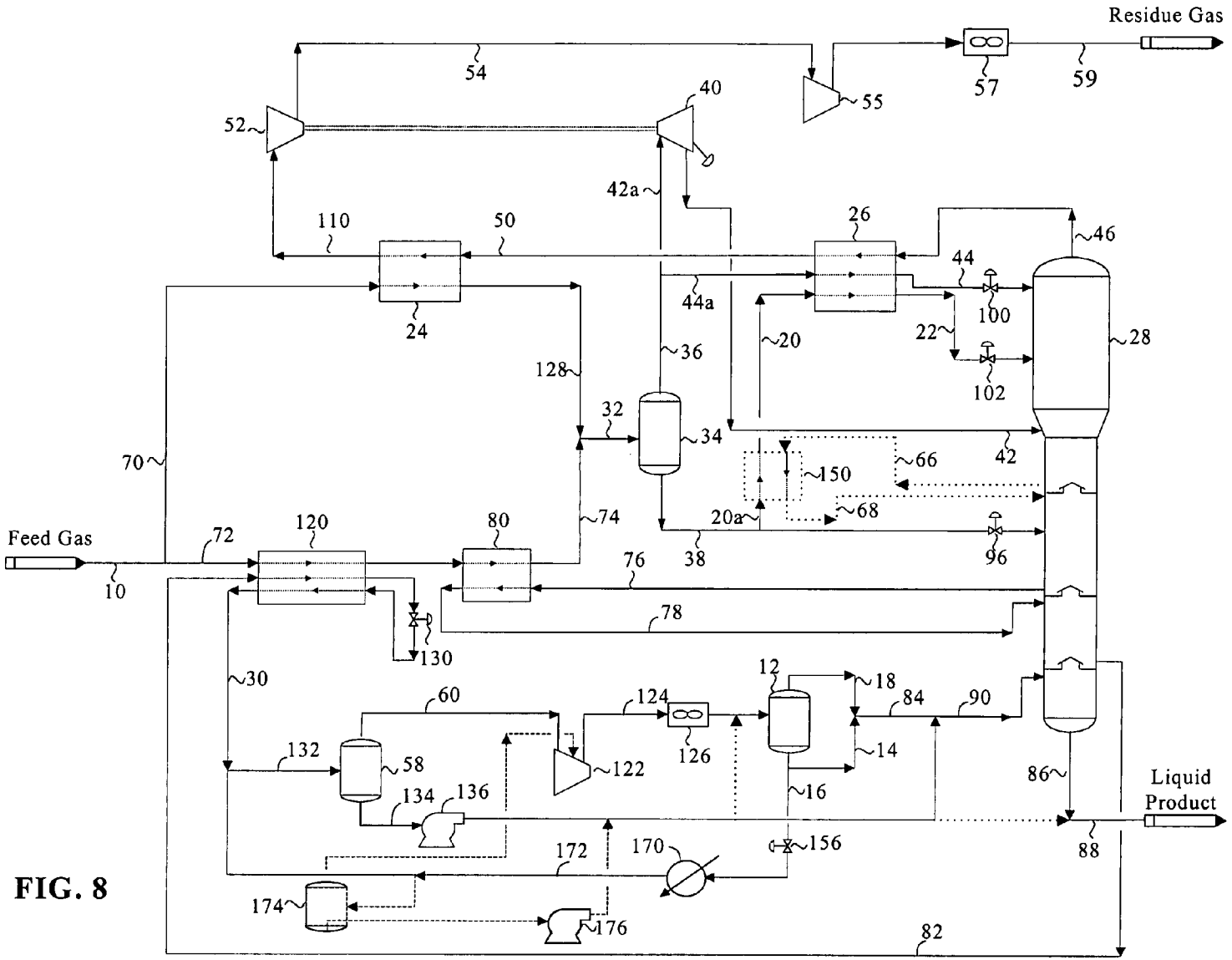
FIG. 8 is an alternative flow diagram of a NGL separation process incorporating the improvement of the present invention.

Another embodiment of the present invention is illustrated in FIG. 8. The description and operation of this scheme is essentially the same as FIG. 3. The main difference is that the liquid stream 82 (representing open cycle refrigerant) and liquid stream 16 (representing closed cycle refrigerant) are used as refrigerants separately, instead of being combined as shown in FIG. 3. The portion of liquid withdrawn from the separator 12, stream 16, can be used as refrigerant in the heat exchanger 170, which may or may not be the same exchanger used for the open cycle refrigerant. The liquid refrigerant 16 is normally heavier in composition than the liquid stream 82 withdrawn from the demethanizer, thereby providing different refrigeration levels as needed for process cooling. After indirect heat exchange with one or more process streams, the heated open refrigerant and closed refrigerant are preferably combined for simplicity and introduced into suction knockout drum 58 where the vaporized refrigerant is separated. The vapor stream 60 is then introduced to the recycle compressor 122 and proceeds on the process similar to the previous embodiment.

It should be noted that the heated open and closed refrigerants can be directed into their individual separators, which may or may not operate at the same pressure level, depending on the refrigeration level needed for each refrigerant.

While the foregoing description is specifically directed to a cryogenic turbo expansion process with only one distillation column employed, more than one distillation column have also been employed to enhance recovery of NGL in the prior art. For instance, a two-column scheme has been widely used to achieve high recovery levels of propane and heavier components. As will be understood by those skilled in the art, the inventive self-refrigeration system disclosed in the above two embodiments can be readily applied to a process with multiple distillation columns. And, depending on optimal level of refrigeration and mixed refrigerant components preferred in the process, the open cycle refrigerant can be withdrawn from either the first column and/or the others.

Application of the present invention in a two-column process is illustrated below. FIG. 9 illustrates a typical two-column scheme with the first column comprising only the rectification for separating and recovering C3+ hydrocarbons in accord with the methods of the present invention. However, as discussed in the "BACKGROUND OF THE INVENTION", many variations, including rectification and/or stripping section for the first column, sources of propane-lean reflux, arrangement of heat exchanger, and physical arrangement of the columns, have been disclosed in the prior art. The application of the present invention in the two-column scheme is therefore not limited to this embodiment. It is intended to cover all alternatives, modifications and equivalents as may be included in the spirit of the invention as defined in the appended claims.

Figure 9:
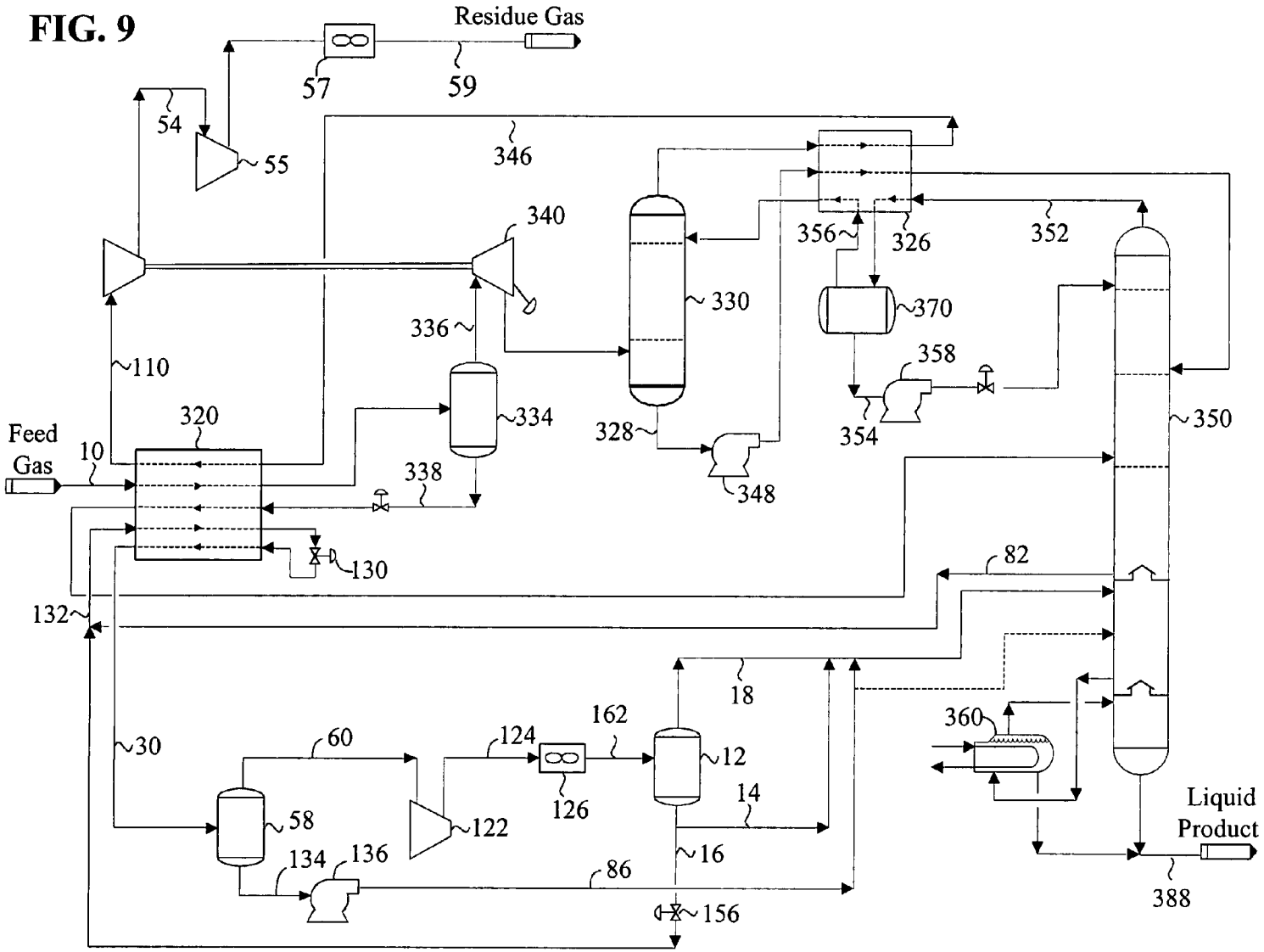
FIG. 9 is an alternative flow diagram of a NGL separation process with two-column scheme incorporating the improvement of the present invention.

Referring to FIG. 9, a pretreated and clean feed gas stream 10 is introduced into the illustrated process. It is first cooled in feed gas exchanger 320 to partial condensation and thereafter directed into separator 334 where the condensed liquid 338 is separated from the vapor stream 336. The vapor stream 336 is subject to turboexpansion via a work-expansion turbine 340 prior to entering the first column 330 below the rectifying section. The bottom liquid 328 from the first column 330 and the liquid stream 338 from separator 334 thus obtained still contain a high level of more volatile components than propane, such as methane and ethane. Both liquids are forwarded to the second column 350 preferably at different feed trays for further fractionation after being heated, while providing proper refrigeration for other process streams in reflux exchanger 326 and feed gas exchanger 320, respectively. Depending on the operating pressure between the first column 330 and the second column 350, a transfer pump 348 may be needed for the bottom liquid 328 to overcome the hydraulics differential between these two columns. Alternately, a compressor (not shown in FIG. 9) may be used for the overhead stream from the second column 350 when the second column 350 is operated at a pressure sufficiently lower than the first column. In yet another variation, the first column 330 may be integrated into the top portion of the second column 350, eliminating the need of either a transfer pump 348 or the overhead compressor.

Within the second column 350, the more volatile components are stripped out from the bottom liquid product 388 containing principally propane and heavier components as desired using external heat partially supplied from bottom reboiler 360. The overhead stream 352 comprised largely of more volatile components is first cooled in reflux exchanger 326 and then forwarded to an accumulator 370 for separating the condensed liquid 354. The condensed liquid 354 is delivered to the top portion of column 350 as liquid reflux via a reflux pump 358.

Un-condensed vapor 356, lean in propane, from accumulator 370 is further cooled in reflux exchanger 326 and delivered to the top of the first column 330 as reflux to enhance overall propane recovery. The residue gas 346 exiting the upper portion of the first column 330 is fed to reflux exchanger 326, providing partial refrigeration for condensing streams 352 and 356, and is further warmed to near the feed gas temperature via feed gas exchanger 320. The warm residue gas 110 is compressed to a final pressure for delivery to sales gas pipeline as stream 359 in a manner similar to that described in FIG. 3.

In this non-limiting embodiment of the present invention, internal refrigeration detailed below is introduced. Stream 82 is withdrawn from the second column 350 at an appropriate recovery tray as the open cycle refrigerant. It is preferentially subcooled in the feed gas exchanger 320 prior to being expanded through expansion device 130. Alternately, the drawn stream 82 can be directly expanded to a lower pressure without subcooling. The expanded stream is directed back to the feed gas exchanger 320 providing indirect heat exchange with the feed gas stream 10 and other streams, and thereafter fed to the suction knockout drum 58 where unvaporized liquid 134, if any, is separated. While the refrigerant is used for feed gas cooling illustrated here, it may be used as effectively for other process cooling. Likewise, heat exchangers 320 and 326 may be arranged differently as to the number of exchangers used and the streams interchange energy within each exchanger. The vapor stream 60 from knockout drum 58 is withdrawn from the top thereof to recycle compressor 122 and is preferably cooled in recycle compressor cooler 126, resulting in a partially condensed stream 162. Stream 162 is recycled back to the second column 350 as the enhancement vapor to enhance separation efficiency within the column. Furthermore, the temperature of stream 162 is so controlled as to provide a portion of reboiler heat, reducing external heat input requirement via bottom reboiler 360.

In the case where additional refrigeration is needed, a separator 12 can be optionally employed to separate the condensed liquid from the partially condensed stream 162. At least a portion of the condensed liquid from separator 12 is withdrawn and modulated by the control device 156 as closed cycle refrigerant 16. The closed cycle refrigerant 16 can be combined with the liquid stream 82 withdrawn from the second column 350, resulting in a mixed refrigerant 132, before it is directed to feed gas exchanger 320 for feed gas cooling. If preferred, refrigerant 16 can be used separately from refrigerant 82 for other process cooling in a manner similar to those described in FIG. 8. The vapor stream 18 from the separator 12 returns to column 350 as the enhancement vapor. While the enhancement vapor can be introduced back into various locations in the column, the location below the draw tray typically will be more effective. The remaining liquid portion of stream 14 from separator 12 and the liquid stream 134 from knockout drum 58 are routed back to the lower portion of the second column 350 at appropriate locations, typically lower than where the enhancement vapor returns. Nevertheless, either liquid stream 14 or 134 can combine with enhancement vapor 18 to simplify system design as shown.

In the foregoing specification, the invention has been described with reference to specific embodiments thereof, and has been demonstrated as effective in providing structures and processes for enhancing operational efficiency of a cryogenic turbo-expansion process for NGL extraction. However, it will be evident to those skilled in the art that various modifications and changes can be made thereto without departing from the broader spirit or scope of the invention. Accordingly, the specification is to be regarded in an illustrative rather than a restrictive sense. For example, it is anticipated that by routing certain streams differently or by adjusting operating parameters, different optimizations and efficiencies may be obtained which would nevertheless not cause the system to fall outside of the scope of the present invention. Additionally, it must also be noted that, while the foregoing embodiments have been described in considerable details for the purpose of disclosure, many variations, e.g., the arrangement and number of heat exchangers and compression stages, may be made therein. Therefore, the invention is not restricted to the preferred embodiments described and illustrated but covers all modifications which may fall within the scope of the appended claims.

What is claimed is:

1. A process for recovering relatively less volatile components from a gas mixture while rejecting relatively more volatile components as a residue gas via one or more cryogenic distillation columns wherein internal refrigeration is employed and generated by steps comprising:

a) withdrawing an open cycle refrigerant from one or more locations in a distillation column;

b) combining at least a portion of said open cycle refrigerant and at least a portion of said closed cycle refrigerant from the dividing step (g) below to form a mixed refrigerant;

c) reducing the pressure of said mixed refrigerant for utilizing the resultant refrigeration in other portions of the process by increasing its temperature, and forming a heated mixed refrigerant;

d) separating said heated mixed refrigerant into a first vapor stream and a first liquid stream;

e) increasing the pressure of said first vapor stream and thereafter reducing its temperature to form a partially condensed stream;

f) separating said partially condensed stream into a second vapor stream and a second liquid stream;

g) dividing said second liquid stream into a closed cycle refrigerant and a remaining liquid portion; and h) introducing said second vapor stream as an enhancement vapor to a distillation column selected from the group consisting of:

I) a distillation column same as which said open cycle refrigerant is withdrawn, and II) a distillation column different from which said open cycle refrigerant is withdrawn.

2. The process of claim 1 further comprising passing at least a portion of said gas mixture and at least a portion of said mixed refrigerant through a heat exchanger to reduce the temperature of said portion of said gas mixture and to increase the temperature of said portion of said mixed refrigerant.

3. The process of claim 1 wherein said partially condensed stream is combined with a portion of said first liquid stream prior to said separating step f).

4. The process of claim 1 wherein said mixed refrigerant is further cooled prior to said pressure reduction step c).

5. The process of claim 1 further comprising introducing said remaining liquid portion into a distillation column which may or may not be the same as which said enhancement vapor is introduced into.

6. The process of claim 1 wherein said second vapor stream is reintroduced back into said distillation column either below the tray from which said open cycle refrigerant is withdrawn or the bottom tray depending on said draw locations.

7. A process for recovering relatively less volatile components from a gas mixture while rejecting relatively more volatile components as a residue gas via one or more cryogenic distillation columns wherein internal refrigeration is employed and generated by steps comprising:

a) withdrawing a open cycle refrigerant from one or more locations in a distillation column;

b) reducing the pressure of said withdrawn open cycle refrigerant and utilizing the resultant refrigeration in other portions of the process by increasing its temperature to produce a first heated stream;

c) separating said first heated stream in a separator into a first vapor stream and a first liquid stream;

d) increasing the pressure of said first vapor stream and thereafter reducing its temperature to form a partially condensed stream;

e) separating said partially condensed stream into a second vapor stream and a second liquid stream;

f) dividing said second liquid stream into a closed cycle refrigerant and a remaining liquid portion g) reducing the pressure of said closed cycle refrigerant and thereafter providing different level of refrigeration in other portions of the process by increasing its temperature to produce a second heated stream;

h) further handling said second heating stream as selected from the group consisting of I) joining said first heated stream prior to said separating step c), II) separating said second heated stream into a second vapor phase and a second liquid phase, and therefore combining said second vapor phase with said first vapor stream in the stage of said pressure increasing step d)

i) introducing said second vapor stream as an enhancement vapor to a distillation column, which may be the same, or different as which said open cycle refrigerant is withdrawn from when more than one distillation column are employed.

8. The process of claim 7 further comprising passing at least a portion of said gas mixture and at least a portion of said open cycle refrigerant through a heat exchanger to reduce the temperature of said portion of said gas mixture and to increase the temperature of said portion of said open cycle refrigerant.

9. The process of claim 7 wherein said open cycle refrigerant is further cooled prior to said pressure reduction step b).

10. The process of claim 7 wherein said closed cycle refrigerant is further cooled prior to said pressure reduction step g).

11. The process of claim 7 further comprising introducing said remaining liquid portion into a distillation column which may or may not be the same as which said enhancement vapor is introduced into.

12. The process of claim 7 wherein said second vapor stream is reintroduced back into said distillation column either below the tray from which said open cycle refrigerant is withdrawn or the bottom tray depending on said draw locations.

13. A process for recovering relatively less volatile components from a gas feed while rejecting relatively more volatile components as a residue gas via two cryogenic distillation columns, comprising:

a) introducing a cooled gas/condensate feed into a first distillation column and thereafter separating into a first gas phase primarily comprising more volatile components and into a first liquid phase primarily comprising less volatile components;

b) introducing said first liquid phase into a second distillation column at one or more feed trays for further fractionation to recover relatively less volatile components as a desirable liquid product from the bottom;

c) withdrawing a open cycle refrigerant from said second distillation column;

d) reducing the pressure of said open cycle refrigerant to preferentially vaporize some of said open cycle refrigerant by indirect heat exchange with other process streams to produce a heated stream;

e) separating said heated stream into a vapor stream for use as an enhancement vapor and a first liquid stream; and f) increasing the pressure of said enhancement vapor and reintroducing said pressurized enhancement vapor back into said second distillation column.

14. The process of claim 13 wherein said open cycle refrigerant is further cooled prior to said pressure reduction step d).

15. The process of claim 13 wherein said pressurized enhancement vapor is cooled prior to being reintroduced back into said second distillation column.

16. In an apparatus for recovering relatively less volatile components from a multi-component feed gas while rejecting relatively more volatile components as residue gas with one or more distillation columns, the apparatus comprising:

a) means for withdrawing a open cycle refrigerant from one or more locations of a distillation column disposed below the lowest feed tray in said column;

b) means for combining at least a portion of said open cycle refrigerant and at least a portion of said closed cycle refrigerant from the dividing means (g) below to form a mixed refrigerant;

c) a device for reducing the pressure of said mixed refrigerant and a heat exchanger to preferentially vaporize a portion of said mixed refrigerant by indirect heat exchange with other process streams;

d) a separator for separating said vaporized refrigerant into a first vapor stream and a first liquid stream;

e) a compressor for increasing the pressure of said first vapor stream and a heat exchanger for cooling said compressed first vapor stream to form a partially condensed stream;

f) a second separator for separating said partially condensed stream into a second vapor stream and a second liquid stream;

g) means for dividing said second liquid stream into a closed cycle refrigerant and a remaining liquid portion; and h) means for introducing said second vapor stream as an enhancement vapor to a distillation column, which may be the same, or different as which said open cycle refrigerant is withdrawn from.

17. The apparatus of claim 16 further comprising a heat exchanger for cooling said mixed refrigerant prior to being introduced into the pressure reducing device c).

* * * * *